US006427798B1

(12) United States Patent
Imashige

(10) Patent No.: US 6,427,798 B1
(45) Date of Patent: Aug. 6, 2002

(54) CONSTRUCTION MACHINE WITH MUFFLER COOLING VENT

(75) Inventor: Hirokazu Imashige, Hiroshima (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 0 days.

(21) Appl. No.: 09/615,802

(22) Filed: Jul. 13, 2000

(30) Foreign Application Priority Data

Jul. 16, 1999 (JP) ..... 11-202763

(51) Int. Cl.[7] ..... B60K 11/06; B60K 11/08

(52) U.S. Cl. ..... 180/309; 180/68.1; 180/89.2; 60/320; 123/41.31

(58) Field of Search ..... 180/68.1, 68.2, 180/89.2, 68.4, 309, 296; 123/41.31, 41.57; 60/320

(56) References Cited

U.S. PATENT DOCUMENTS

| | | | | |
|---|---|---|---|---|
| 4,940,100 A | * | 7/1990 | Ueda | 180/68.1 |
| 5,284,115 A | | 2/1994 | Imanishi et al. | |
| 5,575,349 A | * | 11/1996 | Ikeda et al. | 180/68.1 |
| 6,134,816 A | | 10/2000 | Murakami et al. | |

FOREIGN PATENT DOCUMENTS

| | | | |
|---|---|---|---|
| EP | 0 786 366 | | 7/1997 |
| EP | 0 947 706 | | 10/1999 |
| JP | 61-119822 | | 7/1986 |
| JP | 64-034425 | | 3/1989 |
| JP | 5-147446 | * | 6/1993 |

OTHER PUBLICATIONS

Patent Abstracts of Japan, vol. 1997, No. 02, Feb. 28, 1997, JP 08 270012, Oct. 15, 1996.

Patent Abstracts of Japan, vol. 1998, No. 10, Aug. 31, 1998, JP 10 121519, May 12, 1998.

Patent Abstracts of Japan, vol. 1997, No. 04, Apr. 30, 1997, JP 08 333772, Dec. 17, 1996.

* cited by examiner

*Primary Examiner*—Peter C. English
(74) *Attorney, Agent, or Firm*—Oblon, Spivak, McClelland, Maier & Neustadt, P.C.

(57) ABSTRACT

A construction machine is disclosed which comprises an upper rotating structure formed by a revolving frame, an engine room formed at a rear portion of the upper rotating structure and in which are accommodated at least an engine, a radiator, and a muffler, a compartment formed within the engine room and in which the muffler is accommodated, and a vent portion formed in the compartment to make communication between the outside air and the compartment through an underside of the upper rotating structure. According to this construction, heat generated from the muffler is cut off in the compartment and is not transmitted into the engine room, and the outside air is introduced into the compartment through the vent portion to suppress an increase of temperature. Consequently, it is possible to prevent deterioration in the cooling efficiency of the radiator.

9 Claims, 2 Drawing Sheets

CONSTRUCTION MACHINE WITH MUFFLER COOLING VENT

BACKGROUND OF THE INVENTION

1. Field of the Invention

The present invention relates to a construction machine such as a hydraulic excavator.

2. Description of the Related Art

In a conventional hydraulic excavator as a construction machine, both an engine and an exhaust system are accommodated within an engine room. The exhaust system comprises, concretely, an exhaust pipe extending from an exhaust valve of the engine, a muffler connected to the exhaust pipe, and part of a tail pipe extending from the muffler. Heat generated from the engine and heat generated from the exhaust system are accumulated in the interior of the engine room of the conventional hydraulic excavator, so that the internal temperature of the engine room becomes high.

As to the heat generated from the engine, engine cooling water is cooled by a radiator; besides, cooling air is introduced from a cooling fan, thus permitting an increase of temperature to be suppressed. On the other hand, as to the heat generated from the exhaust system, it causes an increase in the internal temperature of the engine room because any special cooling means is not provided. Particularly, the heat generated from the muffler is a primary factor of the increase in temperature because of a large surface area of the muffler which is constituted by an expansion chamber. Once the internal temperature of the engine room thus rises, the ambient temperature of the radiator rises, resulting in that the cooling efficiency of the radiator deteriorates.

According to the prior art, for solving such a problem, a cylindrical cover is mounted around the muffler, or the surface of the muffler is coated with a heat insulating material such as glass wool. However, when the conduction of heat reaches a steady state, heat is generated through the cover or the glass wool and thus the problem of increase in the internal temperature of the engine room has not thoroughly been solved yet.

SUMMARY OF THE INVENTION

It is an object of the present invention to provide a construction machine capable of preventing an increase in the internal temperature of an engine room and consequent deterioration in the cooling efficiency of a radiator which are caused by the generation of heat from an exhaust system, especially a muffler.

The construction machine of the present invention has an upper rotating structure formed by a revolving frame, an engine room formed at a rear portion of the upper rotating structure and in which are accommodated at least an engine, a radiator, and a muffler, a compartment formed within the engine room and in which the muffler is accommodated, and a vent portion formed in the compartment to make communication between the outside air and the compartment through an underside of the upper rotating structure.

In the present invention, the heat generated from the muffler is cut off in the compartment and is not transmitted into the engine room, and the outside air is introduced into the compartment through the vent portion, whereby an increase in temperature is suppressed. Thus, it is possible to prevent deterioration in the cooling efficiency of the radiator.

In the present invention, a bottom plate of the compartment may be a part of the revolving frame and the vent portion may be formed in the bottom plate. In this case, it becomes easier to form the compartment because the revolving frame constitutes the bottom plate of the compartment.

The bottom plate may have an opening formed as a cutout portion and an undercover attached to the opening, and the vent portion may be formed in the undercover. Alternatively, the vent portion may be formed by directly cutting out a part of the revolving frame. which constitutes the bottom plate. In the latter case, it is possible to attain the reduction of cost in forming the vent portion in the compartment because it is only forming apertures by cutting out the revolving frame that is required for the formation of the vent portion.

In the present invention, the radiator may be mounted on a top plate of the compartment. In this case, the top plate of the compartment can be utilized as a mount for fixing the radiator, thus permitting a compact arrangement of the engine, radiator, and exhaust system.

In the present invention, a fan which introduces the outside air forcibly into the compartment may be disposed near the vent portion. In this case, an increase in the internal temperature of the compartment can be suppressed more effectively because the interior of the compartment is ventilated forcibly by rotation of the fan.

In the present invention, an exhaust pipe which connects the engine and the muffler with each other may be accommodated within the compartment, or at least a part of a tail pipe connected to the muffler may be accommodated within the compartment.

Further, a heat insulating member may be affixed to the compartment, or the compartment may be formed by the heat insulating member. The heat insulating member may be a rigid polyurethane foam panel. In these cases, it is possible to enhance the heat conduction cut-off effect.

Further, a vent hole communicating with the compartment may be formed in a side wall of the revolving frame and the outside air introduced into the compartment from the vent portion may be discharged through the vent hole.

DESCRIPTION OF THE PREFERRED EMBODIMENTS

Figure 1:
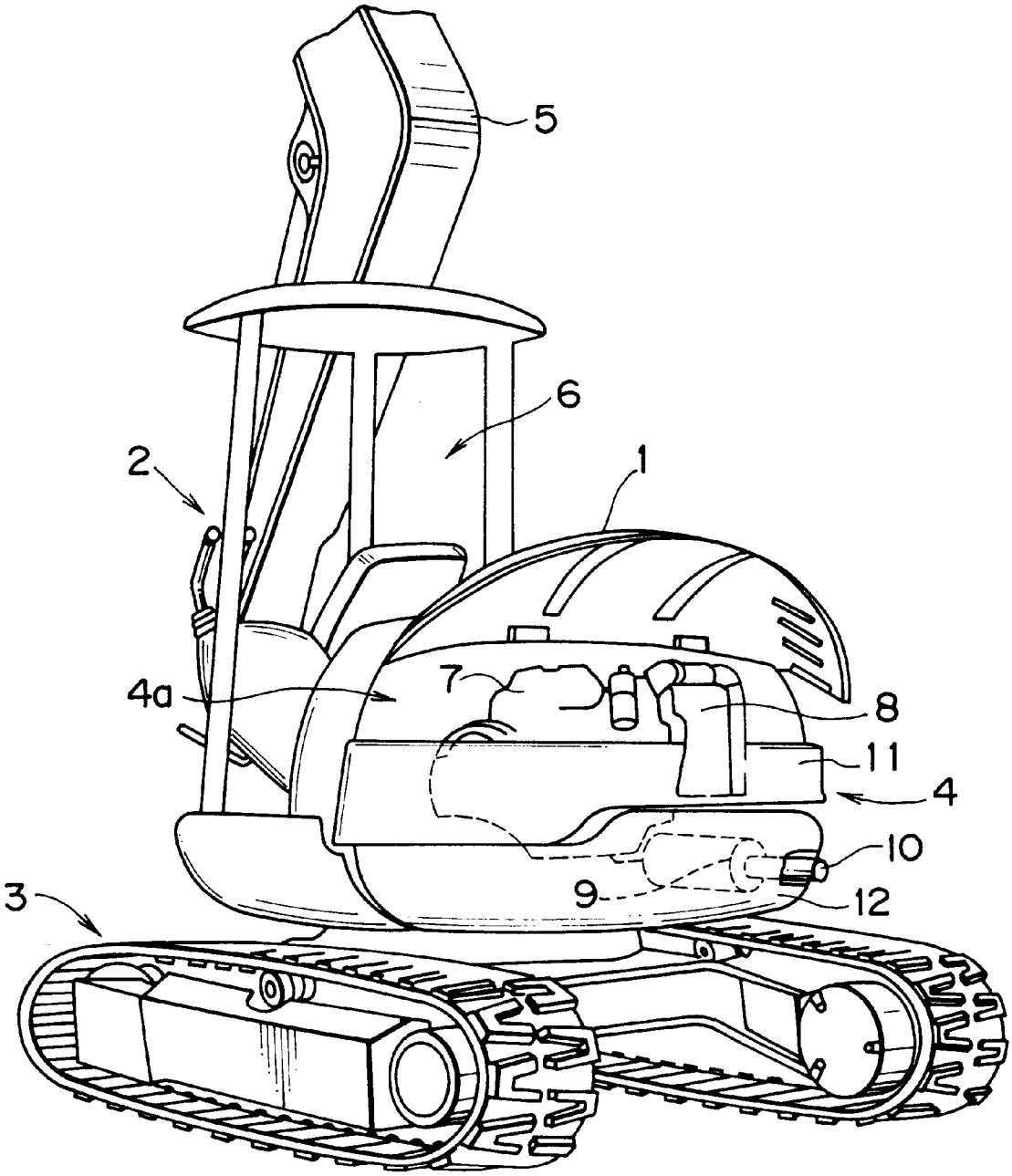
FIG. 1 is a perspective view showing an entire construction of a construction machine according to the present invention.

The present invention will be described in detail hereinunder by way of an embodiment thereof illustrated in the drawings.

FIG. 1 illustrates an entire construction of a hydraulic excavator to which the present invention is applied. In the same figure, the hydraulic excavator is viewed from behind with an engine cover 1 open.

In FIG. 1, the hydraulic excavator 2 comprises a lower travel body 3 and an upper rotating structure 4 mounted on the lower travel body rotatably. A front attachment 5 comprising a boom, an arm, and a bucket is attached to a front portion of the upper rotating structure 4. An operator seat 6 is disposed in the front portion of the upper rotating structure 4. A rear portion defined by a partition wall 4*a* of the upper rotating structure 4 serves as an engine room. Within the engine room are disposed an engine 7, a radiator 8 which constitutes a cooling system, a muffler 9 and a tail pipe 10 as constituents of an exhaust system, and a counter weight 11. Numeral 12 denotes a revolving frame.

Figure 2:
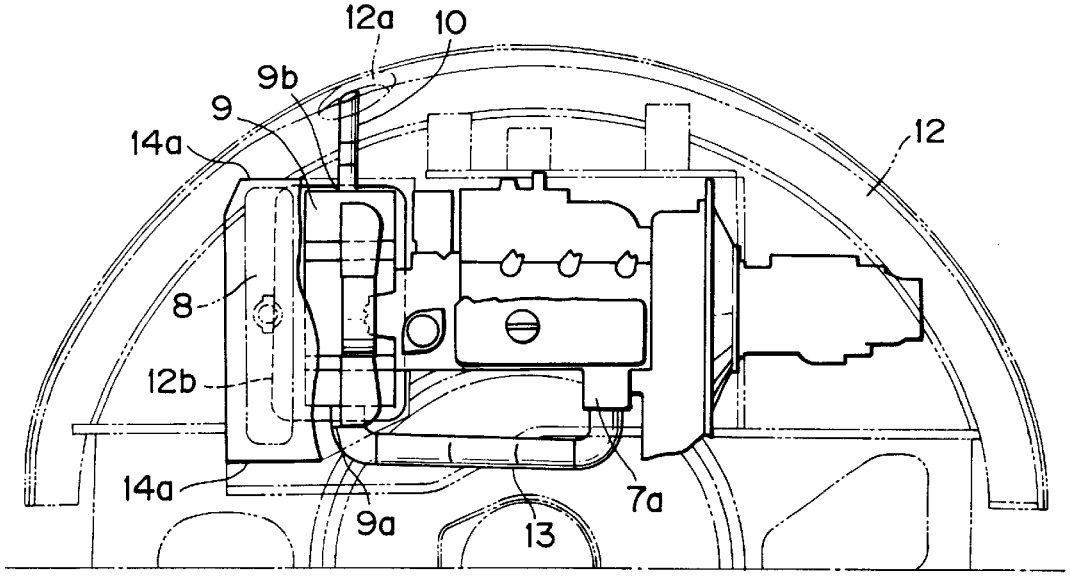
FIG. 2 is a plan view showing how components are arranged within an engine room formed in the construction machine.
Figure 3:
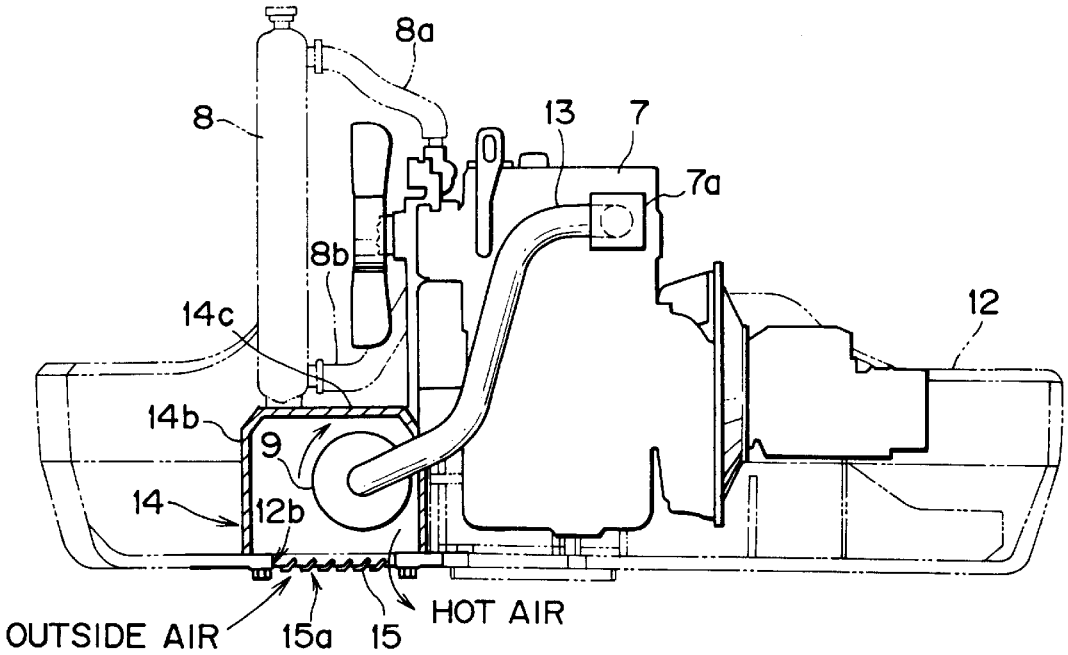
FIG. 3 is a front view of FIG. 2.

Now, with reference to the plan view of FIG. 2 and the front view of FIG. 3, the structure of the exhaust system, which is a characteristic portion of the present invention, will be described below.

In both figures, an exhaust pipe 13 extending obliquely downward from an exhaust valve 7*a* of the engine 7 is connected to an inlet 9*a* of the muffler 9 which is disposed below the engine 7. A tail pipe 10 extending substantially horizontally from an outlet 9*b* of the muffler 9 is conducted to the exterior through a through hole 12*a* formed in a rear end portion of a rear revolving frame 12.

The muffler 9 is accommodated within a compartment 14. The compartment 14 is formed in the shape of a box by installing a gateway-like cover 14*b* on the revolving frame 12, the cover 14*b* having closed both side faces 14*a*.

In a bottom plate (the revolving frame 12) of the compartment 14 there is formed an opening 12*b* by cutting out the bottom plate, which opening 12*b* permits the muffler 9 to be inserted into the compartment 14 horizontally from the exterior. An undercover 15 is attached to the opening 12*b*.

In the undercover 15 are formed a large number of slit-like elongated apertures 15*a* in parallel with one another. The interior of the compartment 14 is in communication with the outside air through the elongated apertures 15*a*. According to this construction, a hot air which has been raised in temperature by the heat generated from the muffler 9 is exchanged with the outside air introduced into the compartment 14 and is then discharged. The elongated apertures 15*a* constitute a vent portion.

Instead of mounting the undercover 15, slit-like apertures may be formed in a portion of the revolving frame 12 which portion is positioned at the bottom of the compartment 14, directly by cutting out the frame portion, to constitute a vent portion.

A top plate 14*c* of the compartment 14 also serves as a mount onto which the radiator 8 is to be installed.

The radiator 8 and the engine 7 are connected together through an upper radiator hose 8*a* serving as a cooling water return pipe and a lower radiator hose 8*b* serving as a cooling water feed pipe.

Cooling water which has been heat-exchanged and cooled by the radiator 8 is fed to the engine 7 from a lower portion of the radiator 8 by means of a water pump (not shown). On the other hand, cooling water which has been heat-exchanged with the engine 7 and thereby raised in temperature while circulating through the engine 7 is discharged from an upper portion of the engine 7 and is returned to the radiator 8 through the upper radiator hose 8*a*.

Thus, the compartment 14 is constructed so as to cut off the heat generated from the muffler 9 and prevent it from being transmitted into the engine room. Besides, such a device as the radiator 8 is installed on the compartment 14 formed in a box shape, thereby contributing to the reduction in size of the mounting space for the devices used in the cooling system and the exhaust system.

The cooling efficiency of the compartment 14 can be enhanced by installing a fan in the vicinity of the vent portion to introduce the outside air forcibly into the compartment.

A vent hole may be formed in a side wall of the revolving frame 12 and may be brought into communication with the interior of the compartment 14 through a duct or the like. In this case, the outside air is introduced into the compartment 14 from the vent portion formed in the bottom plate of the compartment and is heat-exchanged with the muffler 9, then the air thus heated to a high temperature is discharged from the vent hole formed in the side wall of the revolving frame.

In this embodiment, moreover, the muffler 9 which generates the largest amount of heat in the exhaust system is accommodated within the compartment 14 to cut off the conduction of heat. However, it is preferable that the other components of the exhaust system than the muffler are also accommodated within the compartment insofar as a sufficient space can be ensured in the engine room and ventilation can be effected.

A heat insulating member may be affixed to the compartment 14 to enhance the heat conduction cut-off effect. The compartment 14 itself may be formed by a heat insulating member having rigidity such as a rigid polyurethane foam panel.

The construction machine of the present invention is applicable not only to the above hydraulic excavator but also to a self-traveling crane such as a wheeled crane.

I claim:

1. A construction machine comprising:

an upper rotating structure formed by a revolving frame;

an engine room formed at a rear portion of said upper rotating structure, with at least an engine, a radiator, and a muffler being accommodated within said engine room;

a compartment formed within said engine room, with said muffler being accommodated within said compartment; and a vent portion formed in said compartment, the venting portion providing communication between the outside air and said compartment through an underside of said upper rotating structure.

2. The construction machine according to claim 1, wherein a bottom plate of the compartment is constituted by a part of said revolving frame and the vent portion is formed in said bottom plate.

3. The construction machine according to claim 2, wherein said bottom plate has an opening formed as a cutout portion and an undercover attached to the opening, and said vent portion is formed in the undercover.

4. The construction machine according to claim 2, wherein said vent portion is formed by a cut out portion of said revolving frame which constitutes said bottom plate.

5. The construction machine according to claim 1, wherein said radiator is mounted on a top plate of the compartment.

6. The construction machine according to claim 1, wherein an exhaust pipe connects said engine and said muffler with each other, an end of said exhaust pipe extending into said compartment.

7. The construction machine according to claim 1, wherein at least a part of a tail pipe connected to the muffler is further accommodated within said compartment.

8. The construction machine according to claim 1, wherein said compartment is formed by a heat insulating member.

9. The construction machine according to claim 8, wherein said heat insulating member is a rigid polyurethane foam panel.

* * * * *